358-140 SR

8/4/87 XR 4,684,936

United States Patent [19]

Brown et al.

[11] Patent Number: 4,684,936

[45] Date of Patent: Aug. 4, 1987

[54] DISPLAYS HAVING DIFFERENT RESOLUTIONS FOR ALPHANUMERIC AND GRAPHICS DATA

[75] Inventors: Mark W. Brown; Robert E. Dubke, both of Rochester, Minn.

[73] Assignee: International Business Machines Corporation, Armonk, N.Y.

[21] Appl. No.: 602,314

[22] Filed: Apr. 20, 1984

[51] Int. Cl.[4] ..... G09G 1/00

[52] U.S. Cl. ..... 340/721; 340/728; 358/140

[58] Field of Search ..... 340/721, 728; 358/140

[56] References Cited

U.S. PATENT DOCUMENTS

| | | | |
|---|---|---|---|
| 4,486,779 | 12/1984 | Marti | 340/721 |
| 4,491,832 | 1/1985 | Tanaka | 340/721 |
| 4,528,561 | 7/1985 | Kitamura | 340/721 |

*Primary Examiner*—Marshall M. Curtis

*Attorney, Agent, or Firm*—J. Michael Anglin

[57] ABSTRACT

A display terminal presents alphanumeric and graphic data at different resolutions simultaneously. The durations of the individual alphanumeric and graphic dots have a fixed but non-integral ratio to each other, and are mixed together asynchronously to form a combined video signal to a CRT.

13 Claims, 3 Drawing Figures

DISPLAYS HAVING DIFFERENT RESOLUTIONS FOR ALPHANUMERIC AND GRAPHICS DATA

BACKGROUND OF THE INVENTION

The present invention relates to electronic data displays, and more specifically concerns improvements in displays for presenting both alphanumeric (A/N) and graphics data simultaneously.

Alphanumeric text displays are burgeoning throughout the marketplace, and current dot-matrix technology can provide high-quality character images for such displays. Graphics data displays, long used in specialized areas, are rapidly broadening their applications base. Current bit-mapped graphics displays can provide increasingly better images for fields such as business presentations which previously had little or no entree to computer-generated graphics aids. The merger of applications which can use both text and graphics information creates a demand for a single display system which can present both A/N and graphics data on the same screen at the same time.

In the prior art, display units employed several approaches to the simultaneous presentation of A/N text and graphics on the same display.

Mosaic graphics uses entire character areas ("boxes") as single units. Each character is used as one or a small number of on/off picture elements ("pixels"). Typically, an eight-dot-wide by fourteen-dot high character box is divided into four pixels, each four dots wide by seven dots high; sixteen character codes are then allocated to all possible on/off combinations of these pixels. Character codes may also be used to define line characters, non-alphanumeric characters composed of single and doubled strokes for horizontal and vertical lines, intersections, corners, and so on, which can be combined with other such non-alphanumeric characters to form larger images. Such images are usually quite crude, since either the overall pixel size is large or the number of available line characters is small. This approach is commonly used in A/N displays to accommodate a limited graphics capability.

Bit-mapped characters treat text characters as merely another image in a dot-matrix graphics display. That is, an A/N character is drawn on the display along with the graphics shapes and is stored in the frame buffer as a shape having no particular significance as textual information. Several problems dog this approach. The major problem is that the ratio of optimum dot size for the A/N characters to optimum dot size for the graphics data is rarely 1:1. Nor is this ratio any other whole integer such as 2:1 or 3:1; non-integral ratios are much more desirable.

In a typical cathode-ray-tube (CRT) display, 720 A/N dots per horizontal raster scan are necessary to provide acceptable resolution for a line of eighty characters. Memory capacity is only a minor consideration for A/N dot size, because the size of the A/N buffer is independent of the actual number of dots in the character patterns, and the size of the ROM in the usual character generator is well within the capacity of a single inexpensive integrated-circuit chip. On the other hand, 480 dots per scan may be perfectly adequate for presenting graphics data on the same display. One of the majors factor limiting the number of graphics dots per scan is the capacity of the graphics buffer; going from 480 dots to 720 dots per scan—i.e., from the non-integral 3:2 ratio to an integral 1:1 ratio of A/N dots to graphics dots—would require a $\frac{1}{3}$ larger graphics buffer capacity. Decreasing the number of A/N dots to 480 to achieve an integral 1:1 ratio would allow only a six-dot character width, an unacceptable loss of resolution.

Another factor limiting the number of graphics dots is the execution time for graphics programs; computational complexity and time is at least linearly proportional to the number of dots to be manipulated in a bit-mapped display. For this reason also the number of graphics dots in a scan line should be smaller than the number of A/N dots. But integral ratios such as two or three A/N dots per graphic dot—360 or 240 graphics dots per line in the preceding example—usually give unacceptably coarse graphics. In other words, the optimum dot-length ratio for most applications of combined graphics and A/N displays is between 2:1 and 1:1.

SUMMARY OF THE INVENTION

The present invention provides a single display capable of simultaneously presenting both high-quality alpha-numeric and graphics data, by separately optimizing the dot lengths for the A/N and graphics images. The resulting non-integral ratio between these two lengths is achieved with a timing control unit for producing separate A/N and graphics dot-clock signals having a non-integral but fixed ratio to each other, separate A/N and graphics generator units respectively responsive to the dot-clock signals for producing separate A/N and graphics video signals, and a mixer unit for combining the two video signals and transmitting them to a single display unit.

The invention adds very little cost to a conventional display system, and uses components which are conventional in themselves and require no high-bandwidth or high-resolution displays, or other high-capability technology.

DESCRIPTION OF THE PREFERRED EMBODIMENT

Figure 1:
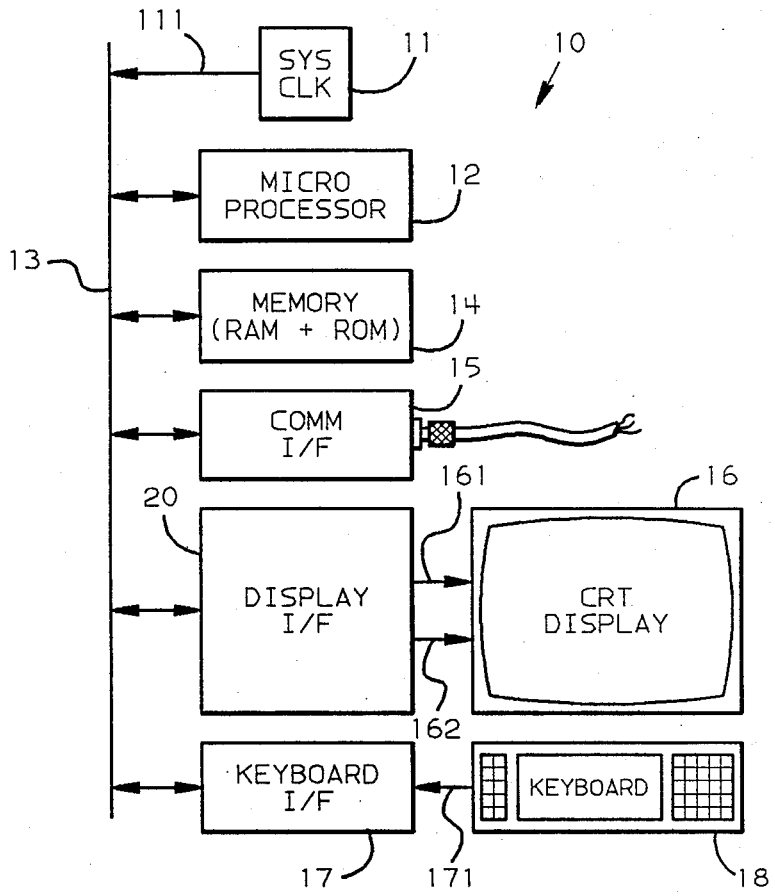
FIG. 1 is a high-level block diagram of a data terminal incorporating the invention.

FIG. 1 shows a data terminal 10 in which the invention may find utility. In its overall organization, terminal 10 is a conventional microprocessor-controlled intelligent terminal capable of displaying both alphanumeric and graphics data transmitted from a host data processor (not shown).

System clock 11 provides one or more fixed clock signals 111 for timing and synchronizing the remaining units of terminal 10. Microprocessor 12 controls the operation of the terminal by means of bus 13 carrying address, data, and control signals. Memory 14 contains read-only memory (ROM) holding fixed operating code and data, and also includes read/write memory (RAM) for variable data and possibly for code downloaded from the host processor. Communications interface 15 manages the communications protocol between the terminal and the host processor via cable 151. Display interface 20 converts data from bus 13 into a video signal 161 acceptable for display on cathode-ray-tube (CRT) display 16. Interface 20 also produces synchronization (sync) signals 162 for timing the raster scan of display 16. Keyboard interface 17 receives signals 171 from keyboard 18 for entering data and operator commands to terminal 10.

Figure 2:
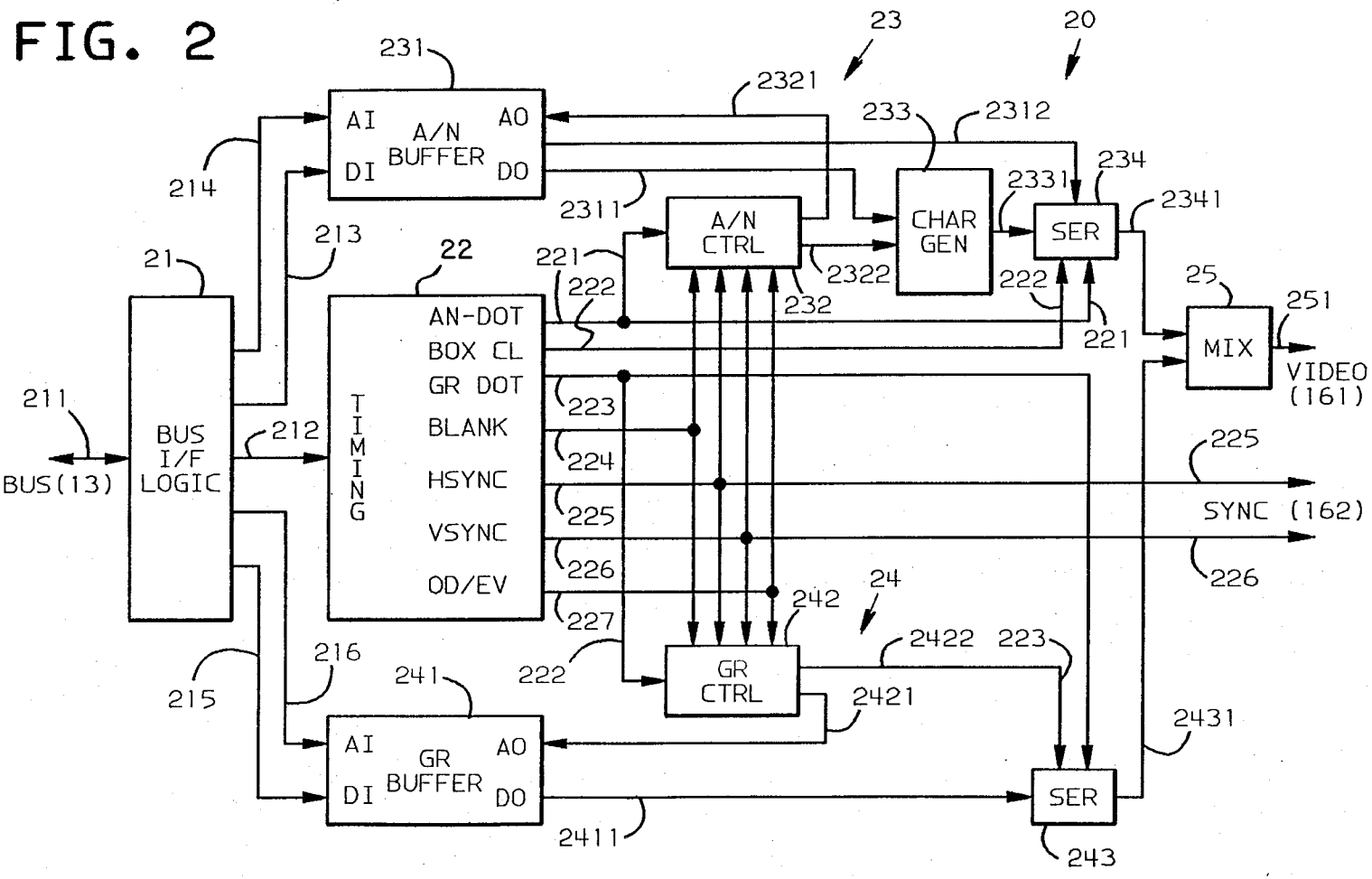
FIG. 2 is a block diagram of the display interface of FIG. 1.

FIG. 2 shows the major units of display interface 20, most of which are of conventional design. Bus-interface logic 21 translates the address, data, and control information on lines 211 from bus 13. Timing unit 22 produces various timing signals, either from its own primary oscillator or derived from system clock 11, FIG. 1, via signal 212 from bus 13.

Timing unit 22 produces a number of signals for synchronizing the display of alphanumeric (A/N) and graphics data simultaneously as a matrix of individual dots in a horizontal raster scan across the face of CRT display 16, FIG. 1. A/N dot clock 221 times each dot of the A/N characters in each scan line. The present embodiment has rows of eighty characters having nine dots each, or 720 dots in the active (unblanked) portion of each horizontal scan line. Graphics dot clock 223 times each dot or pixel of graphics data in each scan line. The present embodiment has 480 pixels in the active portion of each scan line. That is, the interval between successive graphics pixels or dots is 3/2 the interval between successive A/N character dots; equivalently, the frequency ratio of signal 221 to signal 223 is a non-integral factor 3:2.

Timing signal 224 is a conventional blanking pulse occurring at the end of every horizontal scan line and after every frame of scan lines. Signals 225 and 226 are conventional horizontal and vertical synchronizing pulses occurring at the end of every scan line and every frame of scan lines, respectively. These two signals are passed to CRT 16 over sync lines 162, FIG. 1. Conventional odd/even-frame signal 227 reverses polarity at the end of each frame, to provide the proper frame-start timing when an interlaced scan is desired.

A/N generator unit 23 produces a video signal representing the images of character codes in the proper sequence for display. A/N buffer 231 is an addressable read/write memory which receives character codes on data-input (DI) lines 213 and stores them at addresses specified by address-input (AI) lines 214. These data and addresses are determined by bus-interface logic in any conventional manner from information on bus 13. Like most A/N display terminals—but unlike many combined A/N-graphics terminals—character data are stored in buffer 231 in the form of code points in a standard character set, such as ASCII or EBCDIC, rather than directly as dot patterns for the character images.

A/N control logic 232 supplies a sequence of addresses on address-out (AO) lines 2321 to read out the character codes in buffer 231 in the proper order on data-out (DO) lines 2311. Logic 232 includes conventional divider-chain and gating circuits for counting the pulses of A/N dot clock 221 in conjunction with other timing signals such as those on lines 224–227. Another output 2322 carries the number of the scan within the current character row. In the present embodiment, each character image lies with in box nine dots wide by fourteen dots high, so lines 2322 cycle repetitively through counts 0–13 during the active portion of each frame.

Character generator 233 is a read-only memory holding the dot patterns for all character images. Lines 2311 and 2322 combine to address a stored word representing all the dots of the current scan of the current character (addressed by lines 2321) from buffer 231. This word, output as eight parallel bits on lines 2331, is converted to a serial video signal in serializer 234. The serializer may be a conventional shift register having nine bit positions in each addressable word: eight loaded in parallel from lines 2331, the ninth being strapped to ground as an inter-character space. Box clock 222 loads each new character-generator word into the shift register. A/N dot clock 221 shifts the bits out of serializer 234 to produce a serial A/N video signal 2341. For a color display, additional output data specifies the color in which the current character is to appear. Three lines 2312 for red/green/blue (RGB) gate three separate shift registers in serializer 234; each shift register is then loaded with the same data from line 2331, and produces serial RGB video on a separate line 2341.

Graphics generator unit 24 produces a video signal representing the pixels or image elements of a bit-mapped graphics image in the proper sequence for display. Graphics buffer 241 is an addressable read/write memory which receives individual pixels on DI lines 215 and stores them at addresses specified by AI lines 216. These data and addresses are determined by bus-interface logic in any conventional manner from information on bus 13.

Graphics control logic 242 supplies a sequence of addresses on AO lines 2421 to read out the pixels in buffer 241 in the proper order on DO lines 2411. Logic 242 includes conventional divider-chain and gating circuits for counting the pulses of graphics dot clock 223 in conjunction with other timing signals such as those on lines 224–227. For a color display, DO lines 2411 may have three sets of eight lines each, representing the RGB color values of sixteen consecutive pixels.

Serializer 243 converts the parallel bits on lines 2411 into a serial video signal 2431. This serializer may comprise one or more sixteen-position parallel-load shift registers. For a color display, three separate shift registers are used, each loaded from a different set of lines 2411, yielding three separate RGB serial output lines 2431. Control 242 may also produce signal 2422 for loading serializer 243 by merely dividing graphics dot clock 222 by sixteen. The shift-register bit positions are all clocked out to lines 2431 by graphics dot clock 223.

Mixer 25 asynchronously combines the two serial video signals 2341 and 2431 into a single serial video output 251, which is then transmitted to display 16 via video lines 161, FIG. 1. For a color display, a simple form of mixer is merely three two-input OR gates, each receiving one of the three RGB lines of alphanumeric serial video signal 2341 and the corresponding one of the three RGB lines of graphics serial video signal 2431, and producing one of the three RGB lines of the combined video signal 251. Since such OR gates are not clocked or synchronized to any timing signal, the different-length A/N and graphics dots are merely superimposed upon each other at whatever length ratio is determined by other components of the system, such as serializers 234 and 243. More complex logic functions could be implemented in mixer 25 if desired. For, example, A/N dots could be given priority over graphics dots, whenever both occur together.

Figure 3:
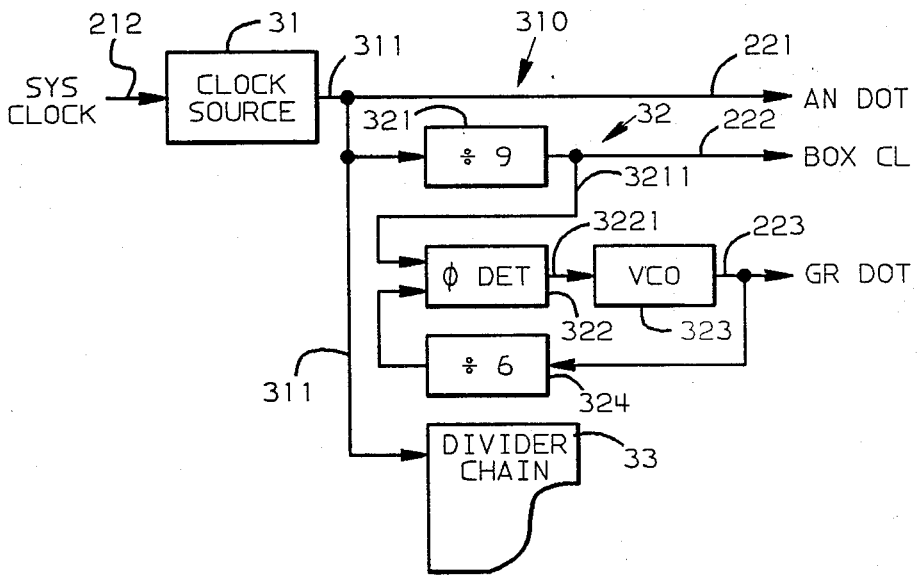
FIG. 3 is a block diagram of the timing control of FIG. 2.

FIG. 3 shows the relevant portion of timing control 22, FIG. 2. Clock source 31 can be a free-running crystal oscillator or a locked oscillator or divider chain synchronized to system clock 11, FIG. 1, by means of timing signal 212. In this embodiment, the output 311 of clock source 31 is itself the A/N dot clock signal 221. For 46 interlaced CRT frames (each having two sets of scan lines) per second and 15,720 horizontal scans per second, successive A/N dot pulses occur at a rate of 14.15 MHz. This yields 720 A/N dots per scan line, or nine dots per character for eighty-character lines.

Frequency modifier unit 32 synchronizes the graphics dot signal 223 at a non-integral ratio to the A/N dot frequency. Conventional divider 321 reduces the frequency of signal 311 by a factor of nine on output line 3211. Line 3211 also serves as a box-clock signal, since it has one pulse for each nine-dot-wide A/N character space or box. Phase detector 322, voltage-controlled oscillator (VCO) 323, and frequency divider 324 form a conventional phase-locked loop. Detector compares 1/9 the frequency of the A/N-dot signal with 1/6 the frequency of the graphics-dot signal from divider 324 and lowpass-filters the phase difference to develop a correction signal 3221 for VCO 323. This maintains the frequency of graphics-dot signal 223 at exactly 6/9 the frequency of A/N-dot signal 221, giving a rate of 9.43 MHz, or 480 graphics dots per scan line. Signal 311 may be further reduced in conventional divider chain 33 to produce the remaining timing signals of timing control unit 22, FIG. 2.

The lining subunit shown in FIG. 2 produces graphics dots having a 3:2 length ratio to the A/N dots. Any other desired ratio is obviously possible with this embodiment. Integral ratios—such as 2:1 or 3:1—could be achieved in a much simpler manner, but non-integral ratios are much more desirable. In this embodiment, for example, 720 A/N dots per scan are required in order to provide acceptable definition in a line of eighty characters. Memory capacity is only a minor consideration for A/N dot size, because the size of the A/N buffer is independent of the actual number of dots in the character patterns, and the size of the ROM in the usual character generator is well within the capacity of a single integrated-circuit chip. On the other hand, one of the majors factor limiting the number of graphics dots per scan is the capacity of the graphics buffer; going from a 3:2 to a 1:1 dot ratio would require a $\frac{1}{3}$ larger graphics buffer capacity. Another factor is execution time for graphics programs; computational complexity and time is at least linearly proportional to the number of dots to be manipulated in a bit-mapped display. Therefore, it is desirable to have a smaller number of graphics dots than A/N dots in a scan line. But integral ratios such as two or three graphics dots per A/N dot (360 or 240 graphics dots per line) usually give unacceptably coarse graphics. In other words, the optimum dot-length ratio for most applications of combined graphics and A/N displays is between 2:1 and 1:1.

Many other changes could also be made within the spirit of the invention. Display systems and technologies other than the microprocessor-controlled data-processor terminal 10 are suitable for embodying the concepts of the invention, as are display technologies other than the interlaced-scan color CRT described above. A/N generator unit 23 and graphics generator unit 24 may vary widely in form and organization. They may, for example, comprise video-controller integrated circuits which are presently available, and they may include portions of what has been here separately called out as timing control unit 22. That part of timing unit 22 relevant to the invention may be implemented in forms other than a phase-locked loop, such as by dividing a much higher initial clock frequency by two different factors having a non-integral ratio to each other. Different functions could be performed in mixer 25, and video mixing could take place at a different point in the system, such as at the stage of parallel signals 2331 and 2411.

We claim:

1. A display unit for displaying simultaneous alphanumeric data and graphic data at different resolutions, comprising:

timing means for producing an alphanumeric timing signal establishing an alphanumeric dot duration, and for producing a graphic timing signal establishing a graphic dot duration, said duration having a fixed but non-integral ratio to each other;

alphanumeric generator means responsive to said alphanumeric dot duration for producing an alphanumeric signal from said alphanumeric data, said alphanumeric signal comprising a plurality of dot pulses each having said alphanumeric dot duration;

graphic generator means responsive to said graphic dot duration for producing a graphic signal froms aid graphic data, said graphic signal comprising a plurality of dot pulses each having said graphic dot duration;

mixing means for combining said alphanumeric signal with said graphic signal so as to produce a video signal representing both said alphanumeric data and said graphic data; and display means responsive to said video signal for producing a simultaneous image of both said alphanumeric data and said graphic data.

2. The display unit of claim 1, wherein said alphanumeric generator includes:

buffer storage means for holding a plurality of character codes representing said alphanumeric data;

character selection means responsive to said timing means for producing a sequence of said character codes;

character generator means for converting said sequence of character codes into said alphanumeric signal synchronized with said alphanumeric timing signal.

3. The display unit of claim 2, wherein said character generator means includes:

image-storage means holding dot patterns for a plurality of characters, said dot patterns being selected by said character codes.

4. The display unit of claim 1, wherein said graphic generator means includes:

pixel storage means for holding a plurality of picture elements each representing one dot location of said graphic data;

pixel selection means responsive to said timing means for producing said graphic signal as a sequence of said picture elements synchronized with said graphic timing signal.

5. The display unit of claim 4, wherein said pixel selection means includes:

counting means incremented by said graphic timing signal for addressing said pixel storage means.

6. The display unit of claim 1, wherein said timing means includes:

a clock source for producing a clock signal at a clock frequency;

first and second frequency-conversion means responsive to said clock signal for producing said alphanumeric and graphic timing signals at frequencies different from each other.

7. The display unit of claim 6, wherein at least one of said frequency-conversion means includes:

a phase-lock loop.

8. The display unit of claim 6, wherein at least one of said frequency-conversion means includes:

a frequency divider.

9. The display unit of claim 1, wherein said mixing means includes:

logic gating means for asynchronously combining said alphanumeric signal with said graphic signal.

10. The display unit of claim 1, wherein said alphanumeric generator means includes buffer storage means for holding a plurality of character codes representing said alphanumeric data; and wherein said graphic generator means includes pixel storage means for holding a plurality of picture elements each representing one dot location of said graphic data, said buffer storage means being separate from said pixel storage means.

11. The display unit of claim 10, wherein said buffer storage means is responsive to said alphanumeric timing signal for accessing said character codes at a first rate; and wherein said pixel storage means is responsive to said graphic timing signal for accessing said graphic data at a second rate different from said first rate.

12. The display unit of claim 10, wherein said alphanumeric generator means further includes character generator means coupled to said buffer storage means by a character-code line; and wherein said graphic generator means further includes a pixel line for carrying said graphics data, said pixel line being coupled to said pixel storage means and being entirely separate from said character-code line.

13. The display unit of claim 10, wherein said buffer storage means and said pixel storage means are of different sizes.

* * * * *